US008296891B1

(12) United States Patent
Rowam et al.

(10) Patent No.: US 8,296,891 B1
(45) Date of Patent: Oct. 30, 2012

(54) PORTABLE VACUUM CLEANING DEVICE

(76) Inventors: David O Rowam, Piney Flats, TN (US); Phillip M Rowan, Jonesborough, TN (US)

( * ) Notice: Subject to any disclaimer, the term of this patent is extended or adjusted under 35 U.S.C. 154(b) by 702 days.

(21) Appl. No.: 12/586,555

(22) Filed: Sep. 24, 2009

Related U.S. Application Data

(63) Continuation-in-part of application No. 11/648,967, filed on Jan. 3, 2007, now abandoned, which is a continuation-in-part of application No. 10/718,156, filed on Nov. 20, 2003, now abandoned.

(51) Int. Cl.
*E04H 4/16* (2006.01)

(52) U.S. Cl. ..... 15/1.7
(58) Field of Classification Search .. 15/1.7; *E04H 4/16*
See application file for complete search history.

(56) References Cited

U.S. PATENT DOCUMENTS 6,502,269 B1 * 1/2003 Balchan et al. ..... 15/1.7
* cited by examiner

*Primary Examiner* — David Redding
(74) *Attorney, Agent, or Firm* — Mark Davis

(57) ABSTRACT

A portable vacuuming device for underwater removal of leaves or the like of a debris field from pool bottoms and other structural surfaces, the device employing a water pump to feed a water jet within a suction cavity wherein the water inlet for the pump is exterior to the cavity and to the housing of the device, and is located well above the debris field.

20 Claims, 2 Drawing Sheets

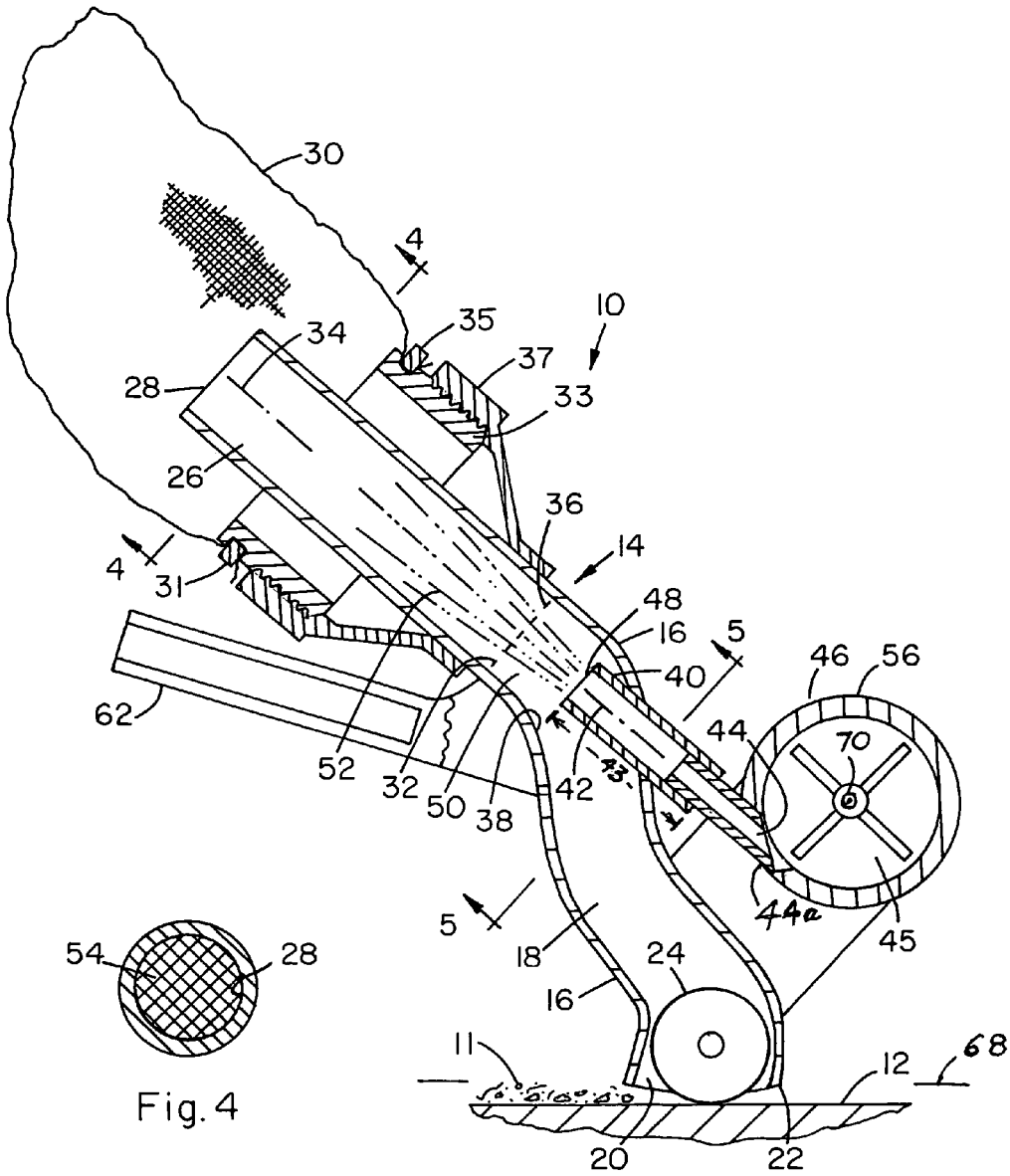
Fig. 3
Fig. 4
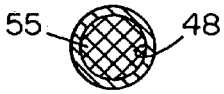
Fig. 5

PORTABLE VACUUM CLEANING DEVICE

This application is a continuation-in-part of applicants application Ser. No. 11/648,967 same titled filed Jan. 3, 2007 now abandoned which is a continuation-in-part of applicants application Ser. No. 10/718,156 of same title filed Nov. 20, 2003 now abandoned.

BACKGROUND

1. Field

This invention relates to devices for cleaning submerged structural surfaces of water bodies such as the bottoms of swimming pools, spas and the like, and particularly concerns unique structure of a water jet operative vacuum type cleaner for removing and filtering out leaves and other such debris from said structural surfaces.

2. Prior Art

A device of this general type is described in U.S. Pat. No. 6,502,269B1 the disclosure of which is hereby incorporated herein by reference in its entirety. A major problem with the cleaner of this patent is that the water-debris intake of the cleaner is in direct fluid communication with intake of the jet pump. In situations where the pool debris contains organic material such as leaves or small pieces of sticks or the like, the pump intake filer will rapidly clog and render the cleaner inoperative.

Principal objects therefore of the invention are: to provide a water jet vacuum type, pool cleaning device which is easy to use and maintain and which preferably utilizes a battery operated water jet pump which, in normal use, virtually cannot be clogged with pool debris; and to provide such device in a structurally simple design and at an economical cost.

SUMMARY OF THE INVENTION

A water jet vacuum cleaning device for vacuuming debris from a debris field on underwater structural surfaces, said device comprising a housing providing a suction cavity communicating with a debris-water suction inlet formed thru said housing, said device being moveable along said surfaces with said suction inlet being in close proximity to said surfaces, said housing being formed with a debris-water discharge conduit having a debris-water outlet which is surrounded by a mesh filter bag extending outside of said housing for entrapping debris, a water ejector tube mounted in said cavity generally in axial alignment with said discharge conduit and adapted for connection exteriorly of said housing to a source of high pressure water or air or the like which is well above said debris field and isolated from said suction inlet, said ejector tube further having a water ejector end located within said cavity and spaced from a debris-water inlet of said discharge conduit to provide a debris entry gap positioned intermediate of and communicating with said inlet and outlet, whereby when water is ejected from said ejector end across said gap and into said discharge conduit the pressure within said cavity will be reduced sufficiently to suck water-debris from said surfaces and into said discharge conduit for transport to said outlet and therethrough into said filter bag.

BRIEF DESCRIPTION OF THE DRAWINGS

The invention and its objects will become further apparent from the drawings herein wherein the various figures are not drawn necessarily to scale or proportion and are intended to facilitate understanding of the invention, and wherein:

FIG. 3 is a cross-sectional view taken along line 3-3 in FIG. 2;

FIG. 4 is a cross-sectional view taken along line 4-4 in FIG. 3 and showing flow area as double cross-hatched;

FIG. 5 is a cross-sectional view taken along line 5-5 of FIG. 3 and showing flow area as double cross-hatched.

DETAILED DESCRIPTION

Figure 1:
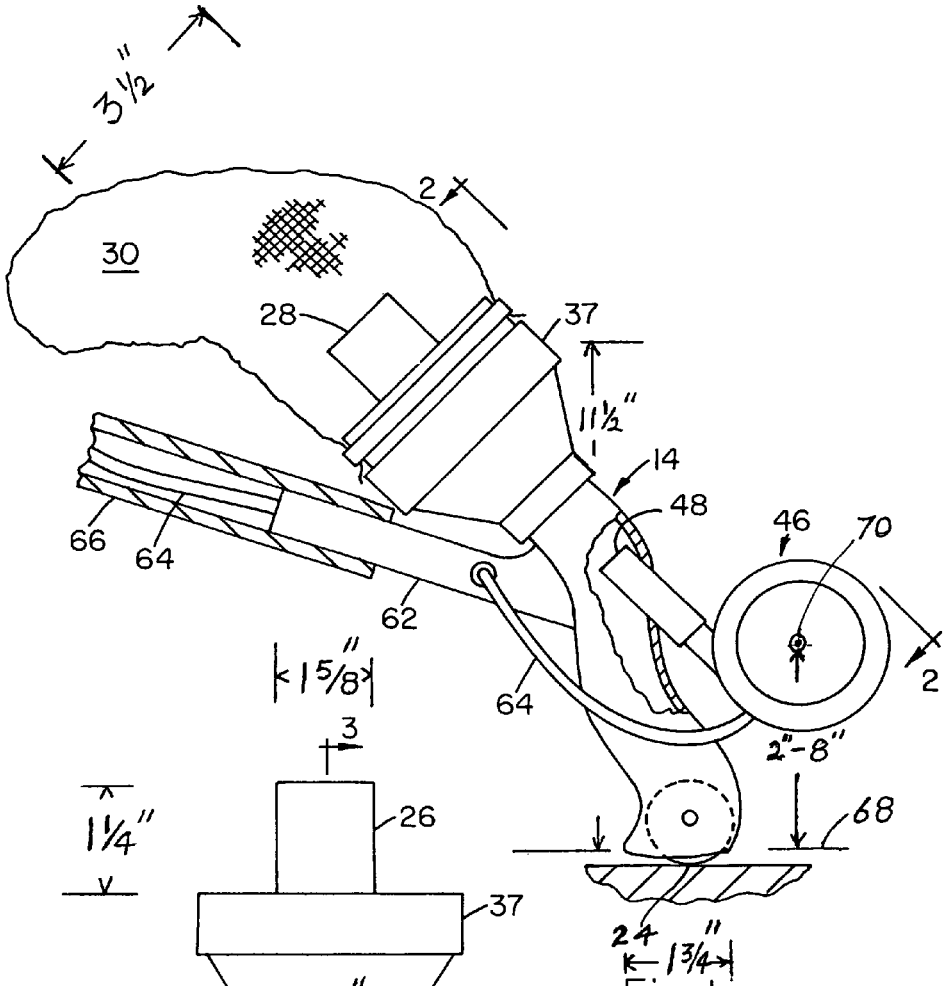
FIG. 1 is a side view of the present device in operating position adjacent a pool bottom surface with portions of the housing of the device broken away for clarity.
Figure 2:
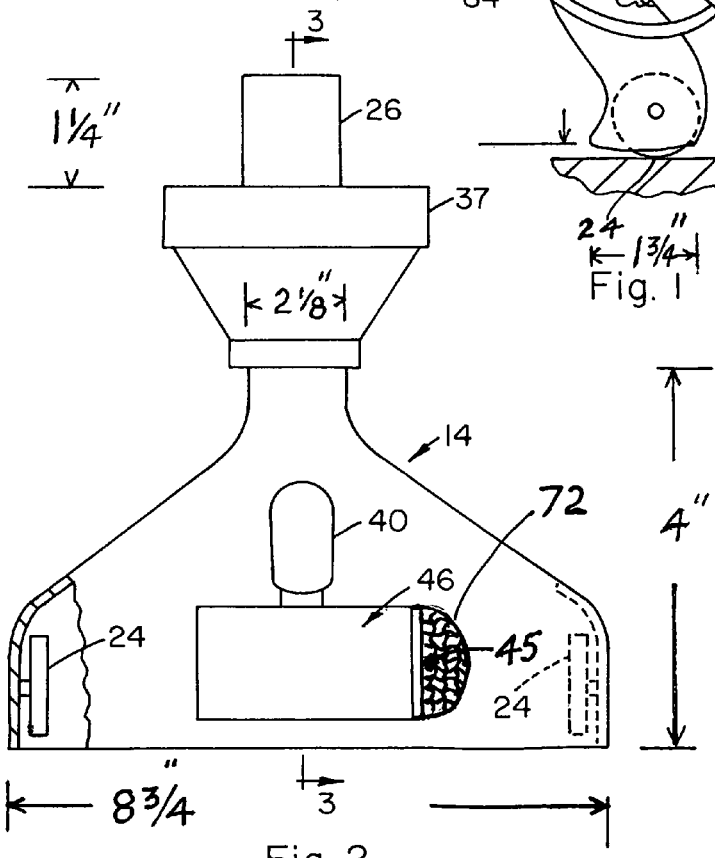
FIG. 2 is a top view of the present device without the filter bag and taken along line 2-2 in FIG. 1 with portions of the housing broken away for clarity.

Referring to the drawings and with particular reference to the claims herein, the present water jet cleaning device 10 for underwater vacuuming of debris 11 from structural surfaces such as bottom 12 of swimming pools or other water bodies comprises a substantially closed housing 14 formed by a wall generally designated 16 preferably of structural plastic such as PVC, cellulosics, butyrates, polyamides, polyolefin or the like, or metal or ceramic, and providing a suction cavity 18. This cavity can be of any operator convenient volumetric capacity and configuration, however the configuration shown in the drawings is preferred with a preferred capacity of from about 400 ml. to about 2,500 ml., most preferably from about 1,000 ml. to about 1,500 ml.

A debris-water suction inlet 20 extends thru said wall into said cavity. This inlet is of a typical elongated generally rectangular configuration of, for example, a flow area of about 10 $in^2$ to about 16 $in^2$ for a cavity capacity of from about 1,000 to about 1,500 ml. The height of the inlet rim 22 from the surface 12 should be preferably from about ⅛ inch to about inch for best results and this height is maintained, e.g., by a pair of wheels 24 mounted on the housing sides adjacent the inlet.

A debris-water discharge conduit 26 formed by said wall has an exit end 28 surrounded by a mesh filter bag 30 of natural or synthetic fibers or thin flat strips or the like and extending exteriorly of said housing and of any desired capacity for entrapping said debris. The filter bag inlet end is affixed in groove 31 encircling an enlarged filter bag attachment collet 33 into which a removable retaining snap ring or band 35 is secured. This collet is threaded into rim 37 provided by wall 16. Conduit 26 has an entry end portion 32 opening into said cavity, and further has a flow axis 34. End portion 32 is depicted in FIG. 3 as a dotted line 36 marking the terminus of the funnel shaped portions 38 of wall 16. In this regard it also marks the outlet end of suction cavity 18.

A fluid ejector tube 40 is mounted in cavity 18 and extends thru said wall 16 and has a flow axis 42, a fluid (water) inlet port 44 on a distal end portion **44*a* thereof which is adapted for connection exteriorly of said cavity to a source 46 of high pressure fluid. This tube further has a fluid ejector end or nozzle 48 located within said cavity and spaced from said entry end 32 of said conduit and thus provides a debris entry gap 50 communicating with said entry end. The ejector tube flow axis 42 and the conduit flow axis 34 are in general alignment for maximizing the suction and transport effect of stream 52** indicated as dotted arrow lines. The term "general alignment" means a preferred deviation from true alignment of no more than about 30°, and most preferably no more than about 10°.

The flow area 54 of the exit end 28 of said conduit is from about 1.5 to about 30 times, preferably 5.0-20.0 times the flow area 55 of the ejector end 48 of said tube, whereby when fluid stream 52 is ejected from said ejector end and across said gap 50 and thru said discharge conduit 26 and into said filter bag 30 the pressure within said cavity 18 will be reduced sufficiently to suck water-debris from said surfaces up to and into said stream for transport into said filter bag container without the inlet 45 of said high pressure source (pump) 46 or the inlet 44 of said tube being exposed to said debris. It is noted that the present construction affords a practically obstructionless passageway from inlet 20 to exit 28 for the debris. A filter screen 72 of, e.g., 1/16" 1/8" wire mesh covens the inlet 45 of pump 46.

As can be seen from FIGS. 1 and 3, the inlet rim 22 of suction inlet 20 lies in an operating plane 68 which is typically just above or within the debris field 11 when the device is in operation. This plane in an exemplary sense and during operation of the device, is only from about 1/8" to about 1/2" above and parallel to the pool floor while, on the dimensioned scale shown in FIGS. 1 and 3, the axis 70 of water pump 46 which supplies high pressure water to ejector tube 40 is, e.g., from about 2" to about 8", preferably from about 2" to about 5½" above plane 68 and rim 22 and well above the pool floor and the debris field. The concept behind these exemplary dimensions is that the ejector water from pump 46 comes directly from a section of the pool water which is well above the rim 22 such that there is no real possibility that pump 46 and/or the ejector tube can become clogged by debris. In this regard, lengthy trial runs of cleaning pools with applicant's device have shown that no such clogging with applicant's device occurs. An exemplary 12 volt pump is marketed under the tradename "rule" and has a capacity of 700 GPH.

The various parts or portions such as wall 16, tube 40, conduit 26, the housing 56 of electric battery operated water pump 46, the attachment collet 33 for the fine mesh filter bag 30, and the operators handle section 62 may be formed by metal fabrication or as a monolithic structure by plastic injection molding or the like, or these parts may be individually provided and plastic welded or adhesively assembled together to form the device.

Handle 62 shown in FIG. 1 preferably carries the electrical leads 64 which extends upwardly thru handle extension 66 to a battery in the manlier shown for example by the aforesaid U.S. Pat. No. 6,502,269 B1, particularly items 12 and 13 described in column 5 thereof.

In preferred embodiments the specifications given below are desirable, wherein the flow areas of 54 and 55 are as stated, with the proviso that the ratio limits (of areas 54/55) of 1.5-30.0 should be adhered to for best results.

| Structure | Preferred | Most Preferred |
|---|---|---|
| Pump 46 capacity | 200-2,000 gal/hr | 500-1,000 gal/hr |
| Gap 50 Length | 0.5 in.-6.0 in. | 1.0 in.-4.0 in. |
| 1/d of inner portion 43 | 1/1 to 15/1 | 3/1 to 6/1 |
| Flow Area of 54 | 0.2 $in^2$ to 7.0 $in^2$ | 0.3 $in^2$ to 3.0 $in^2$ |
| Flow Area of 55 | 0.02 $in^2$ to 0.4 $in^2$ | 0.04 $in^2$ to 0.2 $in^2$ |
| Pump Motor | 6-24 V. | 12-20 V. |
| Mesh opening dia. of filter | 100μ-350μ | 150μ-250μ |

The best mode known at this time is for the diameter (inside) of 26 to be from about 0.75 in. to about 2.0 in., the diameter (inside) of 40 to be from about 0.125 in. to about 0.5 in., and that the axis 70 of pump 46 be from about 3" to about 5½" above rim 22 when the device is of the approximate exemplary dimensions given on the drawings and is in the operating posture shown in FIGS. 1 and 3.

The invention has been described in detail with particular reference to preferred embodiments thereof, but it will be understood that variations and modifications will be effected with the spirit and scope of the invention.

We claim:

1. A cleaning device for underwater vacuuming of debris from structural surfaces such as the bottom of swimming pools or other water containing structure and comprising a substantially closed housing formed by wall and providing a suction cavity, a debris-water suction inlet extending thru said wall and opening into said suction cavity and adapted to be moved with said device along said surfaces in proximity thereto and any debris field thereon, a debris-water discharge stream conduit formed by said wall and having an exit end surrounded by a filter container which is affixed to and extends outwardly of said housing for entrapping said debris, said discharge conduit having a flow axis and opening into said suction cavity, a water ejector tube having a flow axis and being mounted thru a portion of said wall which lies downstream of said suction inlet and above said suction inlet, said tube having a water ejector end extending into said suction cavity and having a water inlet end extending outwardly thru said portion of said wall, a water inlet port on said inlet end of said ejector tube and being connected to a high pressure water pump the inlet of which is located exteriorly of said housing at a location above and isolated from said suction inlet and said any debris field, and when the device is in use said pump inlet is in immediate communication with a section of the body of water in said water containing structure and above said suction inlet, said pump inlet being isolated from said suction cavity and said discharge stream conduit and from any water or debris therein, said ejector end being spaced from said wall and communicating with said discharge conduit, the ejector tube flow axis and the discharge conduit flow axis being in general alignment, wherein the ratio of the flow area of said discharge conduit to the flow area of said ejector tube is always within the limits of from about 1.5 to about 30.0, whereby when a water stream is ejected from said ejector end and thru said discharge conduit and into said filter container, the pressure within said suction cavity will be reduced sufficiently to suck water-debris from said surfaces up thru said suction inlet and into said debris-water stream for transport into said container without said inlet port of said ejector tube and said inlet of said high pressure water pump being exposed to said debris-water discharge stream.

2. The device of claim 1 wherein the flow area of said discharge conduit is from about 5.0 times to about 20.0 times the flow area of said ejector tube.

3. The device of claim 1 wherein said ejector tube is round in cross section and has an inner portion (43) of uniform diameter having a length to diameter ratio of from about 1/1 to about 15/1.

4. The device of claim 3 wherein the flow area of said discharge conduit is from about 10 times to about 20 times the flow area of said ejector tube, wherein the diameter of said discharge conduit is from about 0.75 in. to about 2.0 in., and wherein the diameter of said ejector tube is from about 0.125 in. to about 0.5 in.

5. The device of claim 1 wherein the flow area of said discharge conduit is from about 0.2 $in^2$ to about 7.0 $in^2$, wherein the flow area of said ejector tube is from about 0.02 $in^2$ to about 0.4 $in^2$, wherein said fluid is water, wherein said high pressure fluid source comprises a centrifugal water pump mounted on said housing and having a water feed inlet located outside of said housing and isolated from said suction inlet, and wherein the operational flow rate of said pump is from about 200 to about 2,000 gal./hr.

6. The device of claim 1 wherein said filter container comprises a flexible mesh fabric bag having from about 100μ to about 350μ size openings.

7. The device of claim 6 wherein said openings range in size from about 150μ to about 250μ.

8. The device of claim 1 wherein said pump is battery operated at between about six and twenty four volts, and wherein said battery is electrically connected to said pump thru elongated handle means affixed to said housing and adapted to extend above a swimming pool edge for maneuvering of said device along a pool surface by an operator outside of said pool.

9. The device of claim 5 wherein said battery operates at between about 12 to about 20 volts.

10. The device of claim 1 wherein the volumetric water capacity of said suction cavity is from about 400 to about 2500 ml., and wherein said high pressure fluid is water, wherein said fluid source comprises a water pump having a water feed inlet located outside of said device, and wherein the operational flow rate of said pump is from about 200 to about 2,000 gal./hr.

11. A cleaning device (10) for underwater vacuuming of debris (11) from structural surfaces (12) such as the bottom of swimming pools or other water bodies and comprises a substantially closed housing (14) provided by a wall (16) which is formed to provide an upstream suction cavity (18) for opening into a water body thru a rim (22) defining a debris-water suction inlet (20) adapted to be brought into close proximity to a structural surface to be cleaned, and to provide a debris-water discharge conduit (26) downstream of said suction cavity and having an open exit end (28) which is surrounded by a debris container (30) positioned exteriorly of said homing (14) for entrapping said debris (11) carried into said container by debris-water discharge stream (52), said discharge conduit (26) having a flow axis (34) and an entry end portion (32) opening into said suction cavity (18), a water ejector tube (40) mounted thru said wall (16) and having a distal end portion extending exteriorly of and outwardly from said housing and providing a high pressure water inlet (44), said ejector tube (40) having an ejector end portion (48) extending into said suction cavity (18) within said housing, said ejector tube (40) having a flow axis (42) substantially in alignment with the flow axis (34) of said discharge conduit (26), said inlet (44) being connected to a high pressure water pump (46) located exteriorly of said housing and remote from said rim (22) and communicating with discharge stream (52) only thru ejector tube (40) whereby no portion of said discharge stream (52) can flow into contact with said high pressure water pump, said ejector end portion (48) being spaced from said wall (16) and wherein the flow area of said discharge conduit (26) is from about 1.5 to about 30.0 times the flow area of said ejector tube (40), whereby when a water stream is ejected from said ejector nozzle (48) and out thru said discharge conduit and into said container the pressure within said suction cavity will be reduced sufficiently to suck debris-water from said structural surfaces up to and into said stream (52) for transport out into said container without the inlet port (44) of said ejector tube and the high pressure water source (46) being exposed to any surface debris either outside of said housing (14) or within said suction cavity or within said discharge conduit.

12. The device of claim 11 wherein the flow area of said conduit is from about 1.0 $in^2$ to about 2.0 $in^2$, and wherein the flow area of said ejector tube is from about 0.1 $in^2$ to about 0.4 $in^2$.

13. The device of claim 12 wherein said high pressure fluid source comprises a water pump (46) having a water feed inlet located outside of said housing and spaced above said inlet rim (22), and wherein the operational flow rate of said pump is from about 500 to about 1,000 gal./hr.

14. The device of claim 13 wherein the volumetric water capacity of said suction cavity is from about 800 to about 1800 ml. 16.

15. The device of claim 12 wherein the flow area of said conduit is from about 0.2 $in^2$ to about 7.0 $in^2$, wherein the flow area of said tube is from about 0.02 $in^2$ to about 0.4 $in^2$, wherein said fluid is water, wherein said high pressure fluid source comprises a centrifugal water pump mounted on the outside of said housing and having a water feed inlet located outside of said housing, and wherein the operational flow rate of said pump is from about 200 to about 2,000 gal./hr.

16. The device of claim 13 wherein said debris container comprises a flexible mesh fabric bag having from about 150μ to about 250μ size openings.

17. The device of claim 15 wherein said pump is battery operated at between about six and fourteen volts, and wherein said battery is electrically connected to said pump thru elongated handle means affixed to said housing and adapted to extend above a swimming pool edge for maneuvering of said device along a pool surface by an operator outside of said pool.

18. The device of claim 1 wherein the flow area of said discharge conduit is from about 0.2 $in^2$ to about 3.0 $in^2$, wherein the flow area of said tube is from about 0.004 $in^2$ to about 0.2 $in^2$, wherein said fluid is water, wherein said high pressure fluid source comprises a centrifugal water pump mounted on the outside of said housing and having a water feed inlet located outside of said housing, and wherein the operational flow rate of said pump is from about 200 to about 2,000 gal./hr.

19. The device of claim 18 wherein said debris container comprises a flexible mesh fabric bag of natural or synthetic fibers and having from about 100μ to about 350μ size openings, wherein said pump is battery operated at between about six and fourteen volts, and wherein said battery is electrically connected to said pump thru elongated handle means affixed to said housing and adapted to extend above a swimming pool edge for maneuvering of said device along a pool surface by an operator positioned outside of said pool.

20. The device of claim 1 wherein the inlet of said pump is located from about 2.0 in. to about 8.0 in. above said suction inlet.

* * * * *